US005709974A

United States Patent [19]

Yuh et al.

[11] Patent Number: 5,709,974

[45] Date of Patent: Jan. 20, 1998

[54] HIGH SPEED ELECTROPHOTOGRAPHIC IMAGING MEMBER

[75] Inventors: Huoy-Jen Yuh; Anthony M. Horgan, both of Pittsford; Damodar M. Pai, Fairport; John S. Chambers, Rochester; Richard L. Schank, Pittsford; John F. Yanus, Webster, all of N.Y.

[73] Assignee: Xerox Corporation, Stamford, Conn.

[21] Appl. No.: 722,347

[22] Filed: Sep. 27, 1996

[51] Int. Cl.[6] ..... G03G 5/47; G03G 5/147

[52] U.S. Cl. ..... 430/59; 430/66

[58] Field of Search ..... 430/58, 59, 66, 430/67

[56] References Cited

U.S. PATENT DOCUMENTS 4,871,634 10/1989 Limburg et al. ..... 430/54

5,028,502 7/1991 Yuh et al. ..... 430/31

5,155,200 10/1992 Limburg et al. ..... 528/67

5,368,967 11/1994 Schank et al. ..... 430/59

*Primary Examiner*—John Goodrow

[57] ABSTRACT

An electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

12 Claims, No Drawings

HIGH SPEED ELECTROPHOTOGRAPHIC IMAGING MEMBER

BACKGROUND OF THE INVENTION

This invention relates in general to electrophotographic imaging member and more specifically, to high speed electrophotographic imaging systems utilizing overcoated imaging members having a charge transport layer.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers. The plate or photoreceptor can also be imaged utilizing a dark area discharge scheme. In this process, the charged device is exposed by a laser source which selectively discharges the dark areas of the original document. Development in this scheme involves toner particles adhering to the discharged areas of the image. The resulting toner image is subsequently transferred to a suitable receiving member such as paper.

One common type of photoreceptor is multilayered device that comprises a conductive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in an inactive film forming binder. This type of charge transport layer is described, for example in U.S. Pat. No. 4,265,990. Although excellent toner images may be obtained with such multilayered photoreceptors, it has been found that a plateau is reached when attempts are made to increase charge carrier mobility in the charge transport layer, particularly when the charge transport layer is fabricated by dip coating. Charge carrier mobilities determine the velocities at which the photoinjected carriers transit the transport layer. To achieve maximum discharge or sensitivity for a fixed exposure, the photoinjected carriers must transit the transport layer before the imagewise exposed region of the photoreceptor arrives at the development station. To the extent the carriers are still in transit when the exposed segment of the photoreceptor arrives at the development station, the discharge is reduced and hence the contrast potentials available for development are also reduced. For greater charge carrier mobility capabilities, it is normally necessary to increase the concentration of the active small molecule transport compound dissolved or molecularly dispersed in the binder. Generally, active small molecule transport compounds do not dissolve or molecularly disperse well in most inactive film forming polymeric binders. For example, less than 10 percent by weight of active aromatic diamine small molecule charge transport compounds can be dissolved or molecularly dispersed in phenoxy resins. Although higher concentrations of active aromatic diamine small molecule charge transport compounds may be achieved with polycarbonate resins, the active small molecule charge transport compound tends to crystallize as the concentration of the active small molecule transport compound is increased in the binder, particularly when applied as a solution by dip coating techniques. The limit to the maximum concentration of the small molecule is set by the onset of crystallization in the transport layer. This molecular concentration limit before the onset of crystallization, is found to be dependent on the fabrication process. Thus, in order to apply charge transport layers to photoreceptors by dip coating and avoid exceeding the maximum concentration limit set by onset of crystallization in the transport layer, lower concentrations of small molecule transport compounds must be used and this lower concentration tends to reduce charge carrier mobility in the charge transport layer of multilayered photoreceptors. Lower charge carrier mobility reduces the processing speed of electrophotographic copiers, duplicators and printers.

It has been established in the prior art that for a given concentration of charge transport molecule, the charge carrier mobilities are higher with low dipole containing binders such as polystyrene. Photoreceptors are cycled many thousand of times in automatic copiers, duplicators and printers. This cycling causes degradation of the imaging properties of photoreceptors, particularly multilayer organic photoreceptors which utilize polystyrene binders in the transport layer. Such wear is accelerated when the photoreceptor is utilized in systems employing abrasive development system such as single component systems. Wear is even greater problem when a drum is utilized which has such a small diameter that it has to rotate several times merely to form images for each conventional size 8.5 inch by 11 inch document. Large decreases in thickness due to wear can cause dramatic changes in electrical characteristics in only a few thousand electrical cycles that cannot be compensated by even sophisticated computerized control apparatus. Wear rates limit the usefulness of polystrene binders in systems containing abrasive development and cleaning systems. Although the charge carrier mobilities are higher with devices employing low dipole content binders such as polystyrene in the transport layer as compared to devices containing polycarbonate binders in the transport layers, the wear rate of devices containing polystyrene binders are considerably higher than the devices containing polycarbonate binders in the transport layer.

Protective overcoatings have been discussed in the prior art to reduce wear rates and increase life. An overcoat designed for a particular device may not work on a device containing a different material package due to problems associated with the injection of the charge carriers from the transport layer into the overcoat. Moreover, many overcoatings tend to accumulate residual charge during cycling. This can cause a condition known as cycle-up in which the residual potential continues to increase with multi-cycle operation. This can give rise to increased densities in the background areas of the final images.

Thus, in automatic imaging systems utilizing multilayered photoreceptors, there are deficiencies that limit electrophotographic life. This affects the practical value of multilayered photoreceptors for high speed automatic electrophotographic copiers, duplicators and printers.

INFORMATION DISCLOSURES STATEMENT

U.S. Pat. No. 5,028,502 issued to Yuh et al. on Jul. 2, 1991—An electrophotographic imaging process including providing an electrophotographic imaging member containing a charge generating layer and a charge transport layer containing polystyrene film forming binder and certain specified aromatic diamine or certain specified hydrazone charge transport molecules, depositing a uniform electrostatic charge on the imaging member with a corona charging device, exposing the imaging member to activating radiation in image configuration to form an electrostatic latent image on the imaging member, developing the electrostatic latent image with electrostatically attracting marking particles to form a toner image, transferring the toner image to a receiving member and repeating the depositing, exposing developing and transferring steps, the time elapsed between the exposing and the developing steps being between about 0.5 milliseconds and about 500 milliseconds.

U.S. Pat. No. 4,871,634 to W. Limburg et al., issued Oct. 3, 1989—A hydroxy arylamine compound, represented by a specific formula, is disclosed as employable in photoreceptors. The hydroxy arylamine compound can be used as an overcoating with hydroxy arylamine compound bonded to a resin capable of hydrogen bonding such as a polyamide possessing alcohol solubility.

U.S. Pat. No. 5,368,967 to R. Shank et al., issued Nov. 29, 1994—An overcoat layer is disclosed comprising a small molecule hole transporting arylamine having at least two hydroxy functional groups, a hydroxy or multihydroxy triphenyl methane and a polyamide film forming binder capable of forming hydrogen bonds with the hydroxy functional groups of the hydroxy arylamine and hydroxy or multihydroxy triphenyl methane.

CROSS REFERENCE TO RELATED APPLICATIONS

This application is related to the following U.S. Patent Applications:

U.S. patent application Ser. No. 08/721,817, pending filed concurrently herewith in the names of R. Schank et al., entitled "COMPOSITIONS AND PHOTORECEPTOR OVERCOATINGS CONTAINING A DIHYDROXY ARYLAMINE AND A CROSSLINKED POLYAMIDE"—An electrophotographic imaging member is disclosed including a supporting substrate coated with at least a charge generating layer, a charge transport layer and an overcoating layer, the overcoating layer including a dihydroxy arylamine dissolved or molecularly dispersed in a crosslinked polyamide matrix. The overcoating layer is formed by crosslinking a crosslinkable coating composition including an alcohol soluble polyamide containing methoxy methyl groups attached to amide nitrogen atoms, a crosslinking catalyst and a dihydroxy arylamine. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. patent application Ser. No. 08/721,811 now U.S. Pat. No. 5,681,679 filed concurrently herewith in the names of R. Schank et al., entitled "OVERCOATED ELECTROPHOTOGRAPHIC IMAGING MEMBER WITH RESILIENT CHARGE TRANSPORT LAYER"—A flexible electrophotographic imaging member is disclosed free of an anticurl backing layer, the imaging member including a supporting substrate uncoated on one side and coated on the opposite side with at least a charge generating layer, a charge transport layer and an overcoating layer, the transport layer including a resilient hole transporting arylamine siloxane polymer and the overcoating including a polyamide crosslinked with a dihydroxy amine, forming an electrostatic latent image on the imaging member, depositing toner particles on the imaging member in conformance with the latent image to form a toner image, and transferring the toner image to a receiving member. This imaging member may be utilized in an imaging process including forming an electrostatic latent image on the imaging member, depositing toner particles on the imaging member in conformance with the latent image to form a toner image, and transferring the toner image to a receiving member.

U.S. patent application Ser. No. 08/722,759 now U.S. Pat. No. 5,670,291 filed concurrently herewith in the names of A. Ward et al., entitled "PROCESS FOR FABRICATING AN ELECTROPHOTOGRAPHIC IMAGING MEMBER"—A process is disclosed for fabricating an electrophotographic imaging member including providing a substrate coated with at least one photoconductive layer, applying a coating composition to the photoconductive layer by dip coating to form a wet layer, the coating composition including finely divided silica particles, a dihydroxy amine charge transport material, an aryl amine charge transport material that is different from the dihydroxy amine charge transport material, a crosslinkable polyamide containing methoxy groups attached to amide nitrogen atoms, a crosslinking catalyst, and at least one solvent for the hydroxy amine charge transport material, aryl amine charge transport material and the crosslinkable polyamide, and heating the wet layer to crosslink the polyamide and remove the solvent to form a dry layer in which the dihydroxy amine charge transport material and the aryl amine charge transport material that is different from the dihydroxy amine charge transport material are molecularly dispersed in a crosslinked polyamide matrix.

Thus there is a continuing need for electrophotographic imaging members having improved resistance to resolution loss and deletion, improved stability when exposed to ultraviolet radiation and continuing need for higher mobility values at low concentration of the active transport molecules and members with low wear rates in a xerographic environment.

SUMMARY OF THE INVENTION

It is, therefore, an object of the present invention to provide an improved electrophotographic imaging member which overcomes the above-noted disadvantages.

It is yet another object of the present invention to provide an electrophotographic imaging member exhibiting improved xerographic speeds.

It is still another object of the present invention to provide an electrophotographic imaging member exhibiting improved charge carrier mobilities at lower concentration of the transport molecules.

It is another object of the present invention to provide an electrophotographic imaging member possessing improved stability when exposed to ultraviolet radiation.

It is yet another object of the present invention to provide an electrophotographic imaging system for high speed imaging.

It is still another object of the present invention to provide an electrophotographic imaging member for high speed imaging systems, the imaging member having low wear rates.

The foregoing objects and others are accomplished in accordance with this invention by providing an electrophotographic imaging member comprising a charge generating layer, a charge transport layer and an overcoating layer, the transport layer comprising a charge transporting aromatic diamine molecule in a polystyrene matrix and the overcoating layer comprising a film forming polymer polyamide and a hydroxyaryl amine. This imaging member is employed in an imaging process comprising providing an electrophotographic imaging member comprising a supporting substrate, a charge generating layer, a charge transport layer and an overcoating layer, the transport layer comprising a charge transporting molecule in a polystyrene matrix and the overcoating layer comprising a hole transporting hydroxy arylamine compound having at least two hydroxy functional groups and a polyamide film forming binder capable of forming hydrogen bonds with the hydroxy functional groups of the hydroxy arylamine compound, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps, the time elapsed between the exposing and the developing steps is between about 0.5 millisecond and about 500 milliseconds. These imaging members may be fabricated by dip coating techniques and used in high speed imaging apparatus.

Preferably, the aromatic diamine molecule in the charge transport layer is a material represented by the general formula:

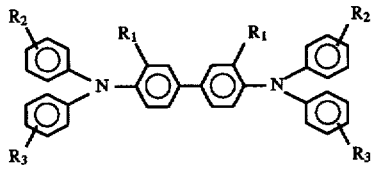

wherein $R_1$ represents hydrogen, an alkyl group or an alkoxy group, $R_2$ represents a hydrogen atom, an alkyl group, an alkoxy group, a halogen atom, an alkoxycarbonyl group or a substituted amino group and $R_3$ represents an alkyl group, an alkoxy group, a halogen atom, an alkoxycarbonyl group or a substituted amino group.

Preferably, the overcoating layer comprises a dihydroxy arylamine dissolved or molecularly dispersed in a polyamide matrix. The overcoating layer is preferably formed from a coating composition comprising an alcohol soluble polyamide and a dihydroxy arylamine.

Electrostatographic imaging members are well known in the art. Electrostatographic imaging member may be prepared by various suitable techniques. Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate is preferably in the form of a rigid cylinder.

The thickness of the substrate layer depends on numerous factors, including strength and rigidity desired and economical considerations. Thus, this layer may be of substantial thickness, for example, about 5000 micrometers, or of minimum thickness of less than about 150 micrometers, provided there are no adverse effects on the final electrostatographic device. The surface of the substrate layer is preferably cleaned prior to coating to promote greater adhesion of the deposited coating. Cleaning may be effected, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. For negatively charged photoreceptors the blocking layer allows electrons to migrate toward the conducting layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isoproopyl tri(N,N-dimethylethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. No. 4,291,110, U.S. Pat. No. 4,338,387, U.S. Pat. No. 4,286,033 and U.S. Pat. No. 4,291,110. The disclosures of U.S. Pat. No. 4,338,387, U.S. Pat. No. 4,286,033 and U.S. Pat. No. 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layers should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, dupont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocynines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, substituted 2,4-diaminotriazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thickness outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer comprises an aromatic diamine dissolved or molecularly dispersed in electrically inactive polystyrene film forming binder. The specific aromatic diamine is added to polystyrene materials which are normally incapable of supporting the injection of photogenerated holes from the generation material and incapable of allowing the transport of these holes there through. This converts the electrically inactive polystyrene material to a material capable of supporting the injection of photogenerated holes from the generation material and capable of allowing the transport of these holes through the active layer in order to discharge the surface charge on the active layer. The expression "Electrically active" when used to define the charge transport layer means that the material is capable of supporting the injection of photogenerated holes from the generating material and capable of allowing the transport of these holes through the active layer in order to discharge a surface charge on the active layer. The expression "Electrically inactive" when used to describe the electrically inactive organic resinous binder material which does not contain any aromatic diamine or hydrazone compounds of the instant invention means that the binder material is not capable of supporting the injection of photogenerated holes from the generating material and is not capable of allowing the transport of these holes through the material. An especially preferred transport layer employed in one of the two electrically operative layers in the multilayered photoconductor of this invention comprises an aromatic diamine charge transporting compound and a polystyrene film forming resin in which the mixture aromatic amines is soluble. Without being limited by theory, it is believed that the interaction of the charge transporting donor molecules with polystyrene is different from that in polycarbonate due to the presence of polar groups in polycarbonate. It is possible that the strong dipole-dipole interaction between the polycarbonate polymer chains can hinder the proper alignment of the charge transporting donor molecules for easy charge exchange. Polystyrene like binders with no strong dipole groups yield the higher mobilities. The binder polymer compound may be represented by the general formula:

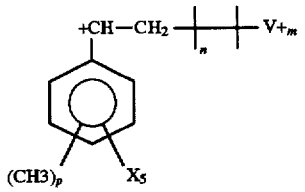

wherein:

n=0 to 1, m=1 to 1, m+n=1, p=0, 1, 2 or 3,

X=—CN, Cl, Br, $—CH_2CH_3$, $—CH(CH_3)_2$, or $—CH_2—CH_2—CH_3$, s=0, 1, 2 or 3, p+s=0, 1, 2, 3 4 or 5,

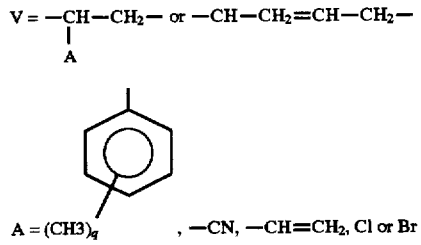

q=1, 2, or 3.

Typical polystyrene film forming binder materials represented by the above formula include, for example, poly(styrene), poly(p-methylstyrene), poly(2,4-methylstyrene), poly(p-chlorostyrene), poly(styrene-co-butadiene), poly(p-methylstyrene-co-butadiene), poly(styrene-co-isoprene), poly(styrene-co-vinylchloride), poly(styrene-co-acrylonitrile), poly(p-chlorostyrene-co-isoprene), poly(p-isopropylstyrene-co-styrene), poly(p-isopropylstyrene-co-acrylonitrile), poly(m-methylstyrene), poly(p-methoxystyrene), poly(p-methoxystyrene-co-vinylchloride) and the like.

The polystyrene film forming electrically inactive resin binder materials should have a weight average molecular weight between about 20,000 and about 5,000,000, more preferably between about 50,000 and about 300,000. When the weight average molecular weight is less than about 20000, the solution has poor viscosity resulting in difficult coating conditions. Also, the mechanical property of this coating is poor, resulting in cracks on the coating. Weight average molecular weights greater than about 5,000,000 can result in very high viscosities that render processing difficult.

The inactive polystyrene resin binder is soluble in methylene chloride, toluene, tetrahydrofuran, 1,1,2 dichloroethane, monochlorobenzene, mixtures thereof, and other suitable solvents.

The aromatic diamine charge transport layer compound may represented by the general formula:

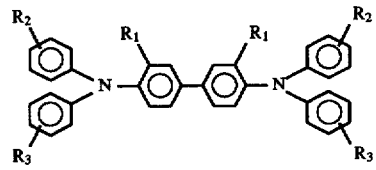

wherein $R_1$ represents hydrogen, an alkyl group or an alkoxy group, $R_2$ represents a hydrogen atom, an alkyl group, an alkoxy group, a halogen atom, an alkoxycarbonyl group or a substituted amino group and $R_3$ represents an alkyl group, an alkoxy group, a halogen atom, an alkoxycarbonyl group or a substituted amino group.

Typical charge transporting aromatic amines represented by the structural formula above capable of supporting the injection of photogenerated holes and transporting the holes through the overcoating layer include N,N'-diphenyl-N,N'-bis(alkylphenyl)-(1,1'-biphenyl)-4,4'-diamine wherein the alkyl is, for example, methyl, ethyl, propyl, n-butyl, and the like, N,N'-diphenyl-N,N'-bis(chlorophenyl)-[1,1'-biphenyl-]-4,4'-diamine, N,N'-diphenyl-N,N'-bis(3-methylphenyl)-(1,1'-biphenyl)4,4'-diamine, N,N,N',N'- tetraphenyl-[3,3'-dimethyl-1,1'-biphenyl]-4,4'-diamine; N,N'-diphenyl-N,N'-bis(2-methylphenyl)-[3,3'-dimethyl-1,1'-biphenyl]-4,4'-diamine; N,N'-diphenyl-N,N'-bis(3-methylphenyl)-[3,3'-dimethyl-1,1'-biphenyl]-4,4'-diamine; N,N'-diphenyl-N,N'-bis(4-methylphenyl)-[3,3'-dimethyl-1,1'-biphenyl]-4,4'-diamine; N,N,N',N'-tetra(2-methylphenyl)-[3,3'-dimethyl-1,1'-biphenyl]-4,4'-diamine; N,N'-bis(2-methylphenyl)-N,N'-bis(4-methylphenyl)-[3,3'-dimethyl-1,1'-biphenyl]-4,4'-diamine; N,N'-bis(3-methylphenyl)-N,N'-bis(2-methylphenyl)-[3,3'-dimethyl-1,1'-biphenyl]-4,4'-diamine; N,N,N',N'-tetra(3-methylphenyl)-[3,3'-dimethyl-1,1'-biphenyl]-4,4'-diamine; N,N'-bis(3-methylphenyl)-N,N'-bis(4-methylphenyl)-[3,3'-dimethyl-1,1'-biphenyl]-4,4'-diamine; and N,N,N',N'-tetra(4-methylphenyl)-(3,3'-dimethyl-1,1'-biphenyl]-4,4'-diamine.

A preferred diamine is represented by the general formula:

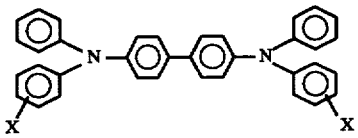

wherein X is selected from the group consisting of an alkyl group containing form 1 to 4 carbon atoms and chlorine.

Satisfactory results may be achieved with between about 15 percent and about 75 percent by weight of the diamine based on the total weight of the diamines in the charge transport layer. Preferably, the charge transport layer of this invention contains between about 20 percent and about 60 percent by weight of the diamine based on the total weight of the diamines in the charge transport layer. When less about 20 percent by weight aromatic amine is employed, charge carrier mobilities are too low and therefore limit the speed of the xerographic process. Concentrations of this diamine greater than about 60 percent can result in crystallization of the transport layer. Specific aromatic diamine charge transport layer compounds encompassed by the formula above are described, for example, in U.S. Pat. No. 4,265,990, U.S. Pat. No. 4,299,897, and U.S. Pat. No. 4,833,054 the entire disclosures thereof being incorporated herein by reference. The substituents on aromatic diamine molecules should be free from electron withdrawing groups such as $NO_2$ groups, CN groups, and the like.

Any suitable and conventional technique may be utilized to mix and thereafter apply the charge transport layer coating mixture to the charge generating layer. Typical application techniques include spraying, dip coating, roll coating, wire wound rod coating, and the like. Preferably, the coating mixture of the transport layer comprises between about 9 percent and about 12 percent by weight polystyrene film forming binder, between about 27 percent and about 3 percent by weight aromatic diamine, and between about 64 percent and about 85 percent by weight solvent for dip coating applications. Drying of the deposited coating may be effected by any suitable conventional technique such as oven drying, infra radiation drying, air drying and the like. However, the charge transport coating mixture of this invention is particularly effective for dip or immersion coating techniques. This is because the maximum concentration of aromatic diamine that can be dispersed in a binder is limited in a dip coating process due to the long residence time of the solvent before the drying step occurs. Thus, phase separation of the diamine can occur during the solvent resident time. Phase separation is undesirable because phase separation results in poor charge transport including residual build which adversely affects print quality.

Generally, the thickness of the hole transport layer is between about 10 about 50 micrometers, but thickness outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of thickness of the hole transport layer to the charge generator layer is preferably maintained from about 2:1 to 200:1 and in some instances as great as 400:1. In other words, the charge transport layer, is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

The charge transport layers containing aromatic diamine and polystyrene and described in U.S. Pat. No. 5,028,502 can provide a charge carrier mobility value that can be considerably higher (thirtyfold) than the mobility values of conventional charge transport layers containing aromatic diamine and polycarbonate film forming binders such as those described, for example, in U.S. Pat. No. 4,265,990. This high mobility value renders operable small diameter cylindrical photoreceptors in high speed electrophotographic copier, duplicators and printers. More specifically, the time between exposure and development steps depends on the diameter of the rigid photoconductor substrate, the position of the development station with respect to the exposure subsystem and the surface velocity of the drum or the process speed. This time is equal to:

$$t_{ED}=\theta\times\text{drum circumference}/360\times\text{surface velocity}$$

where θ is the angular position of the development station (measured from the physical center of the development zone) relative to the exposure station (measured from the physical center of the exposure zone). The physical center of the development zone is defined as the center of the zone adjacent the photoreceptor imaging surface between the point where development of a latent image begins and the point where development of a latent image terminates. Similarly, the physical center of the exposure zone is defined as the center of the zone adjacent the photoreceptor imaging surface between the point where exposure to form a latent image begins and the point where exposure to form a latent image terminates. Also, the erase station can be placed closer to the charging station as a result of the higher mobilities. This time ($t_{ED}$) decreases as the diameter of the drum decreases to decrease the size of the machine and the surface velocity increases to increase the number of copies per minute. The time ($t_{ED}$) elapsed between said exposing and the developing steps for the electrophotographic imaging processes of this invention can be as short between about 0.5 millisecond and about 500 milliseconds. Thus, for example, if the position of the development station relative to the exposure station is 20° with respect to the exposure station for an 84 mm diameter drum, the time between exposure station and the development station is 49 milliseconds for a 300 mm/sec process speed. These times become even smaller for a 40 mm diameter drum. Thus, an aromatic diamine, such as N,N'-diphenyl-N,N'-bis(3-methylphenyl)-(1,1'-biphenyl)-4,4'-diamine, at a 20 weight percent concentration in polycarbonates is not suitable for such applications, whereas the same concentration of the diamine in polystyrene is adequate for electrophotographic development to form toner images. Because of the high charge mobility capability of the photoreceptor of this invention, the time elapsed between the image exposure and image development steps can be as low as between about 0.5 millisecond and about 500 milliseconds. The high charge mobility capabilities of the photoreceptor of this invention also enable the use of rapidly rotating small diameter cylindrical photoreceptors having an outside diameter of between about 4.4 cm and about 8.4 cm. The outside diameter may be even smaller than 4.4 cm provided the other subsystems can be physically accommodated around the circumference. Thus, satisfactory results may be achieved at high speeds with cylindrical photoreceptors having an outside diameter between about 2.2 cm and about 12 cm. Preferably, the cylindrical photoreceptor has an outside diameter between about 4.4 cm and about 8.4 cm for high speed imaging.

The overcoat layer comprises a dihydroxy arylamine dissolved or molecularly dispersed in a polyamide matrix. The overcoat layer is formed from a coating composition comprising an alcohol soluble film forming polyamide and a dihydroxy arylamine.

Any suitable alcohol soluble polyamide film forming binder capable of forming hydrogen bonds with the hydroxy functional materials may be utilized in the overcoating. The expression "hydrogen bonding" is defined as the attractive force or bridge occurring between the polar hydroxy containing aryl-amine and a hydrogen bonding resin in which the hydrogen atom of the polar hydroxy arylamine is attracted to two unshared electrons of a resin containing polarizable groups. The hydrogen atom is the positive end of one polar molecule and forms a linkage with the electronegative end of the polar molecule. The polyamide utilized in the overcoatings should also have sufficient molecular weight to form a film upon removal of the solvent and also be soluble in alcohol. Generally, the weight average molecular weights of polyamides vary from about 5,000 to about 1,000,000. Since some polyamides absorb water from the ambient atmosphere, its electrical property may vary to some extent with changes in humidity in the absence of a polyhydroxy arylamine charge transporting monomer, the addition of charge transporting polyhydroxy arylamine minimizes these variations. The alcohol soluble polyamide should be capable of dissolving in an alcohol solvent which also dissolves the hole transporting small molecule having multi hydroxy functional groups. The polyamides polymers required for the overcoatings are characterized by the presence of amide groups —CONH. Typical polyamides include the various Elvamide resins which are nylon multipolymer resins, such as alcohol soluble Elvamide and Elvamide TH Resins. Elvamide resins are available from E. I. Dupont Nemours and Company. Other examples of polyamides include Elvamide 8061, Elvamide 8064, Elvamide 8023. One class of alcohol soluble polyamide polymer is selected from the group consisting of materials represented by the following formulae I and II:

I

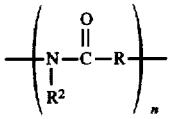

wherein:

n is a positive integer,

R is independently selected from the group consisting of alkylene, arylene or alkarylene units, between 1 and 99 percent of the $R^2$ sites are —H, and the remainder of the $R^2$ sites are $—CH_2—O—CH_3$ and

II

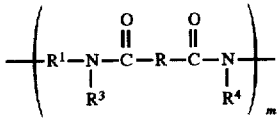

wherein:

m is a positive integer, $R_1$ and R are independently selected from the group consisting of alkylene, arylene or alkarylene units, between 1 and 99 percent of the $R^3$ and $R^4$ sites are —H, and the remainder of the $R^3$ and $R^4$ sites are $—CH_2—O—CH_3$.

The polyamide should also be soluble in the alcohol solvents employed.—Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg 76, John Wiley & Sons Inc. 1968, and the like and mixtures thereof. Other polyamides are Elvamides from Dupont de Nemours & Co. These polyamides can be alcohol soluble, for example, with polar functional groups, such as methoxy, ethoxy and hydroxy groups, pendant from the polymer backbone. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof.

When the overcoat layer contains only polyamide binder material, the layer tends to absorb moisture from the ambient atmosphere and becomes soft and hazy. This adversely affects the electrical properties, the sensitivity of the overcoated photoreceptor. To overcome this, the overcoating of this invention also includes a dihydroxy arylamine. Preferably, the dihydroxy arylamine is represented by the following formula:

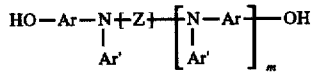

wherein:

m is 0 or 1,

Z is selected from the group consisting of:

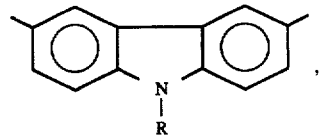

-continued

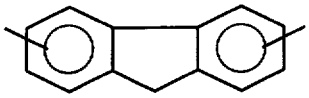

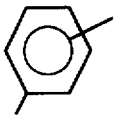

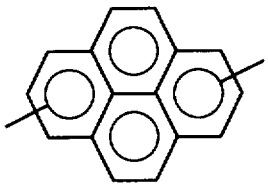

and

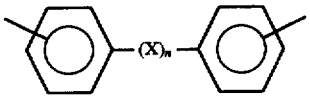

n is 0 or 1,

Ar is selected from the group consisting of:

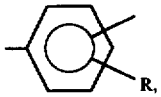

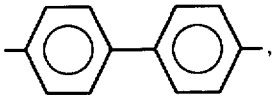

and

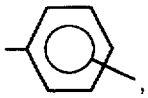

R is selected from the group consisting of —$CH_3$, —$C_2H_5$, —$C_3H_7$ and —$C_4H_9$, Ar' is selected from the group consisting of:

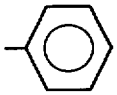

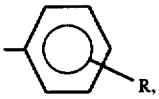

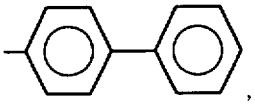

and

-continued

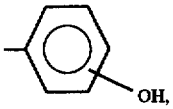

X is selected from the group consisting of:

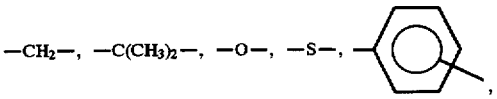

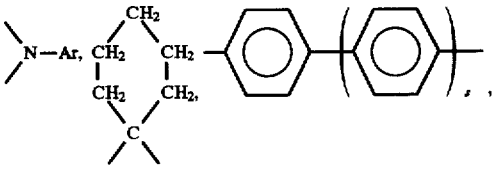

and 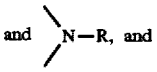

s is 0, 1 and 2.

This hydroxy arylamine compound is described in detail in U.S. Pat. No. 4,871,634, the entire disclosure thereof being incorporated herein by reference.

Generally, the hydroxy arylamine compounds are prepared, for example, by hydrolyzing an dialkoxy arylamine. A typical process for preparing alkoxy arylamines is disclosed in Example I of U.S. Pat. No. 4,588,666 to Stolka et al, the entire disclosure of this patent being incorporated herein by reference.

Typical hydroxy arylamine compounds of this invention include, for example:

N,N'-diphenyl-N,N'-bis(3-hydroxyphenyl)-[1,1'-biphenyl]-4,4'-diamine;

N,N,N',N',-tetra(3-hydroxyphenyl)-[1,1'-biphenyl]-4,4'-diamine;

N,N-di(3-hydroxyphenyl)-m-toluidine;

1,1-bis-[4-(di-N,N-m-hydroxpyphenyl)-aminophenyl]-cyclohexane;

1,1-bis[4-(N-m-hydroxyphenyl)-4-(N-phenyl)-aminophenyl]-cyclohexane;

Bis-(N-(3-hydroxyphenyl)-N-phenyl-4-aminophenyl)-methane;

Bis[(N-(3-hydroxyphenyl)-N-phenyl)-4-aminophenyl]-isopropylidene;

N,N'-diphenyl-N,N'-bis(3-hydroxyphenyl)-[1,1':4',1"-terphenyl]-4,4"-diamine;

9-ethyl-3,6-bis[N-phenyl-N-3(3-hydroxyphenyl)-amino]-carbazole;

2,7-bis[N,N-di(3-hydroxyphenyl)-amino]-fluorene;

1,6-bis[N,N-di(3-hydroxyphenyl)-amino]-pyrene;

1,4-bis[N-phenyl-N-(3-hydroxyphenyl)]-phenylenediamine.

N,N'-diphenyl-N-N'-bis(4-hydroxy phenyl)[1,1'-biphenyl]-4,4'-diamine

N,N,N',N',-tetra(4-hydroxyphenyl)-[1,1'-biphenyl]-4,4'-diamine;

N,N-di(4-hydroxyphenyl)-m-toluidine;

1,1-bis-[4-(di-N,N-p-hydroxpyphenyl)-aminophenyl]-cyclohexane;

1,1-bis[4-(N-o-hydroxyphenyl)-4-(N-phenyl)-aminophenyl]-cyclohexane;

Bis-(N-(4-hydroxyphenyl)-N-phenyl-4-aminophenyl)-methane;

Bis[(N-(4-hydroxyphenyl)-N-phenyl)-4-aminophenyl]-isopropylidene;

Bis-N,N-[(4'-hydroxy-4-(1,1'-biphenyl)]-aniline

Bis-N,N-[(2'-hydroxy-4-(1,1'-biphenyl)]-aniline

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage may develop with cycling resulting in background problems. If the amount of hydroxy arylamine in the overcoat exceeds about 50 percent by weight based on the total weight of the overcoating layer, crystallization may occur resulting resulting in residual cycle-up. In addition, mechanical properties, abrasive wear properties are negatively impacted.

The thickness of the continuous overcoat layer selected depends upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

Any suitable dip or immersion process may be employed for preparing the electrophotographic imaging member of this invention. The coating mixture is normally retained in a dip or immersion coating vessel and the cylindrical substrate to be coated and the vessel may be moved relative to the other. Thus, the substrate may be moved, the vessel may be moved or both may be moved. Generally, movement of the substrate and/or the vessel are effected in a vertical direction.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, optical exposure and development.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

Any suitable conventional electrophotographic charging, exposure, development, transfer, fixing and cleaning techniques may be utilize to form and develop electrostatic latent images on the imaging member of this invention. Thus, for example, conventional light lens or laser exposure systems may be used to form the electrostatic latent image. The resulting electrostatic latent image may be developed by suitable conventional development techniques such as magnetic brush, cascade, powder cloud, and the like. However, the rate at the photoreceptor surface is moved from an image exposure station and image development station is can be much higher than conventionally employed.

The mixture of active aromatic amino charge transport compounds and polystyrene in the charge transport layer of the photoreceptor of this invention exhibits high charge carrier mobility. Greater charge carrier mobility capacities are exhibited at lower concentrations of the active small molecule transport compound dissolved or molecularly dispersed in the polystyrene binder. Also, higher concentrations of active aromatic diamine small molecular charge transport compounds may be achieved with less tendency to crystallize as the concentration of the active diamine transport compound is increased in polystyrene binder, particularly when applied as a solution by dip coating techniques. Thus, the charge transport layers may be applied to photoreceptors by dip coating without exceeding the maximum concentration limit set by the onset of crystallization in the transport layer. Therefore, the high charge carrier mobility of the photoreceptors greatly chances the processing speed of electrophotographic copier, duplicators and printers. The high wear rates of the polystyrene containing transport layers are considerably reduced by the overcoat of polyamide containing dihydroxy arylamine. During the operation, when the negatively charged device is imagewise exposed, the photogenerated injected from the generator layer moves swiftly through the charge transport layer containing polystyrene and is then injected into the overcoat and transported through the overcoat. There is no charge accumulation at the interface between the transport layer containing polystyrene binder and the overcoat containing polyamide binder. This suggests good bonding between the transport layer containing polystyrene and the overcoating coated from an alcohol mixture of polyamide and dihydroxy arylamine.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Eight electrophotographic imaging members are prepared by applying by dip coating a charge blocking layer onto the rough surface of eight aluminum drums having a diameter of 4 cm and a length of 31 cm. The blocking layer coating mixture is a solution of 8 weight percent polyamide (nylon 6) dissolved in 92 weight percent butanol, methanol and water solvent mixture. The butanol, methanol and water mixture percentages are 55, 36 and 9 percent by weight, respectively. The coating is applied at a coating bath withdrawal rate of 300 mm/minute. After drying in a forced air oven, the blocking layers have thicknesses of 1.5 micrometers. The dried blocking layers are coated with a charge generating layer containing 2.5 weight percent hydroxy gallium phthalocyanine pigment particles, 2.5 weight percent polyvinylbutyral film forming polymer and 95 weight percent cyclohexanone solvent. The coatings are applied at a coating bath withdrawal rate of 300 millimeters/minute. After drying in a forced air oven, the charge generating layers have thicknesses of 0.2 micrometers.

EXAMPLE II

Four of the dried generating layers of Example I are coated with charge transport layers containing N,N'-diphenyl-N,N'-bis(3-methylphenyl)-1,1'-biphenyl-4,4'-diamine dispersed in polycarbonate (PCZ200, available from the Mitsubishi Chemical Company). The coating mixture consists of 8 weight percent N,N'-diphenyl-N,N'-bis(3-methylphenyl)-1,1'-biphenyl-4,4'-diamine, 12 weight percent binder 80 weight percent monochlorobenzene solvent. The coatings are in a Tsukiage dip coating apparatus. After drying in a forced air oven for 45 minutes at 118° C., the transport layers have thicknesses of 20 micrometers.

EXAMPLE III

Four of the dried generating layers of Example I are coated with charge transport layers containing N,N'-diphenyl-N,N'-bis(3-methylphenyl)-1,1'-biphenyl-4,4'-diamine dispersed in polystyrene. The coating mixture consists of 8 weight percent N,N'-diphenyl-N,N'-bis(3-methylphenyl)-1,1'-biphenyl-4,4'-diamine, 12 weight percent polystyrene, and 80 weight percent monochlorobenzene solvent. The coatings are in a Tsukiage dip coating apparatus. After drying in a forced air oven for 45 minutes at 118° C., the transport layers have thicknesses of 20 micrometers.

EXAMPLE IV

Two of the drums of Example II are overcoated with an overcoat layer of N,N'-diphenyl-N,N'-bis(3-hydroxyphenyl)-[1,1'-biphenyl]-4,4'-diamine (a dihydroxy arylamine) in Elvamide 8063, available from E. I. dupont de Nemours & Co). 10 grams of a 10 percent weight solution of Elvamide 8063 in a 50:50 weight ratio solvent of methanol and propanol and 1 gram of the dihydroxy arylamine are roll milled for 2 hours and then allowed to stand for several hours before use. 3 micrometer overcoats are applied in the dip coating apparatus with a pull rate of 190 mm/min. The overcoated drums are dried at 125° C. for 1 hour.

EXAMPLE V

Two of the drums of Example III are overcoated with an overcoat layer of N,N'-diphenyl-N,N'-bis(3-hydroxyphenyl)-[1,1'-biphenyl]-4,4'-diamine (a dihydroxy arylamine) in Elvamide 8063, available from E. I. dupont de Nemours & Co). 10 grams of a 10 percent weight solution of Elvamide 8063 in a 50:50 weight ratio solvent of methanol and propanol and 1 gram of the dihydroxy arylamine are roll milled for 2 hours and then allowed to stand for several hours before use. 3 micrometer overcoats are applied in the dip coating apparatus with a pull rate of 190 mm/min. The overcoated drums are dried at 125° C. for 1 hour.

EXAMPLE VI

The electrical properties of the photoconductive imaging samples prepared according to Examples II through V are evaluated with a xerographic testing scanner. The drums are rotated at a constant surface speed of 5.66 cm per second. A direct current wire scorotron, narrow wavelength band exposure light, erase light, and four electrometer probes are mounted around the periphery of the mounted photoreceptor samples. The sample charging time is 177 milliseconds. The exposure light has an output wavelength of 775 to 785 nm and the erase light has an output wavelength of 680 to 720 nm. The relative locations of the probes and lights are indicated in Table A below:

TABLE A

| Element | Angle (Degrees) | Position | Distance From Photoreceptor |
|---|---|---|---|
| Charge | 0 | 0 | Screen at 2 mm |
| Probe 1 | 26 | 9.1 mm | |
| Expose | 45 | 15.7 | N.A. |
| Probe 2 | 68 | 23.7 | |
| Probe 3 | 133 | 46.4 | |
| Erase | 288 | 100.5 | N.A. |
| Probe 5 | 330 | 115.2 | |

The test samples are first rested in the dark for at least 60 minutes to ensure achievement of equilibrium with the testing conditions at 50 percent relative humidity and 72° F. Each sample is then negatively charged in the dark to a potential of about 385 volts. The charge acceptance of each sample and its residual potential after discharge by front erase exposure to 400 ergs/cm$^2$ are recorded. The test procedure is repeated to determine the photo induced discharge characteristic (PIDC) of each sample by different light energies of up to 40 ergs/cm$^2$. The 100 cycle electrical testing results obtained for the test samples of Examples II through V are summarized in Table B below.

TABLE B

| | Example | | | |
|---|---|---|---|---|
| | II | III | IV | V |
| Dielectric thickness | 7.0 | 6.5 | 7.4 | 6.9 |
| V0 (PIDC) | 392 | 394 | 396 | 392 |
| Q/A (PIDC) [nC/cm$^2$] | 49 | 56 | 46 | 53 |
| 0.26 s Duration Decay [v] | 13 | 16 | 14 | 15 |
| % Dark Decay | 3 | 4 | 4 | 4 |
| @0.42 s: VH(0 erg) [v] | 378 | 378 | 382 | 377 |
| V (3 erg/cm$^2$) [v] | 61 | 43 | 77 | 51 |
| V (7 erg/cm$^2$) [v] | 41 | 24 | 57 | 32 |
| V (25 erg/cm$^2$) [v] | 32 | 17 | 47 | 24 |
| @780 nm: dV/dX [volt*cm$^2$/erg] | 264 | 252 | 266 | 259 |
| Verase | 19 | 8 | 29 | 13 |
| Delta Verase (cyc 100 cyc 3) | 3 | 1 | 5 | 2 |
| Temp °F. | 72 | 72 | 72 | 72 |
| % RH | 57 | 55 | 56 | 56 |

With reference to the abbreviations employed in the TABLE:

V0 (PIDC) is the dark voltage after scorotron charging, as measured by probe 1.

Q/A (PIDC) [nC/cm$^2$] is the charge density required to charge the photoreceptor device to the desired voltage V0

0.26s Duration Decay is the average voltage lost in the dark between probes 1 and 2.

% Dark Decay is 0.26s Duration Decay voltage divided by V0, expressed as a percentage.

@0.42s: VH(0 erg) is average dark voltage at probe 2.

V (3 erg/cm$^2$) is average voltage at probe 2 after exposure to 3 erg/cm$^2$ of 780 nm light.

V (7 erg/cm$^2$) is average voltage at probe 2 after exposure to 7 erg/cm$^2$ of 780 nm light V (25 erg/cm$^2$) is average voltage at probe 2 after exposure to 25 erg/cm$^2$ of 780 nm light.

@780 nm: dV/dX is the initial slope of the PIDC obtained using 780 nm light.

Verase is average voltage at probe 4 after erase exposure.

Temp °F. is the scanner chamber environment temperature in degrees Fahrenheit.

% RH is the scanner chamber environment percent relative humidity, a measure of the water content in the air.

The salient features are that the polystyrene drums have lower residuals and the overcoat adds negligibly small addition (<10V) to the residual. In short the xerographic data of drums employing polystyrene binder in the transport layer and an overcoat of Elvamide and dihydroxy arylamine is outstanding. This suggests good bonding between the transport layer containing polystyrene and the overcoating coated from an alcohol mixture of polyamide and dihydroxy arylamine. This result is unexpected.

EXAMPLE VII

Two electrophotographic imaging members are prepared by forming coatings using conventional coating techniques on a suitable comprising vacuum deposited titanium layer on a polyethylene terephthalate film (Mylar, available from E. I. dupont de Nemours & Co.). The first coating is a siloxane barrier layer formed from hydrolyzed gamma aminopropyltriethoxysilane having a thickness of 50 angstroms. This film is coated as follows: 3-aminopropyltriethoxysilane (available for PCR Research Chemicals of Florida) is mixed in ethanol in a 1:50 volume ratio. The film is applied to a wet thickness of 0.5 mil of a multiple clearance film applicator. The layer is then allowed to dry for 5 minutes at room temperature, followed by curing for 10 minutes at 110 degree centigrade in a force air oven. The second coating is an adhesive layer of polyester resin (49,000, available from E. I. dupont de Nemours & Co.) having a thickness of 50 angstroms and was coated as follows: 0.5 grams of 49,000 resin is dissolved in 70 grams of tetrahydrofuran and 29.5 grams of cyclohexanone. The film is coated by a 0.5 mil bar and cured in a forced air oven for 10 minutes. The next coating is a charge generator layer containing 35 percent by weight vanadyl phthalocyanine particles dispersed in a polyester resin (Vitel PE100, available from Goodyear Tire and Rubber Co.) having a thickness of 1 micrometer and is coated as follows: 0.35 gram of vanadyl phthalocyanine pigment and 0.65 gram of polyester (Vitel PE100, available from Goodyear Tire & Rubber Co.) are roll milled for 24 hours employing stainless steel shot in a mixture of solvents containing 12.4 grams of methylene chloride and 5.8 grams of dichloroethane. The film is coated utilizing a 0.5 mil bar and cured at 100 degree centigrade for 10 minutes. The top coating is a charge transport layer of a dispersion of aromatic diamine donor molecules in polycarbonate resin (Makrolon, available from Farbenfabricken Bayer A. G.) having a thickness of 20 micrometers. The transport layer is fabricated by first dissolving two grams of Makrolon Registered TM polycarbonate and 0.5 gram of the aromatic diamine, N,N'-diphenyl-N,N'-bis(3-methylphenyl)-(1,1'-biphenyl)-4,4'-diamine (Diamine 1), in 22.8 grams of methylene chloride. After dissolution, the mixture is coated on the substrate containing the charge generator layer using a 3 mil Bird film applicator. The film is dried in a forced air oven at 100° C. for 20 minutes.

EXAMPLE VIII

One of the two devices of Example VII is overcoated with dihydroxy arylamine in Elvamide 8063. Prior to application of the overcoat layer, the photoreceptor of Example VII is primed by applying 0.1 percent by weight of Elvacite 2008 in 90:10 weight ratio of isopropyl alcohol and water using a # 3 Meyer rod. This prime coating is air dried in a hood. The overcoat composition is prepared by mixing 10 grams of a 10 percent by weight solution of a polyamide (Elvamide 8063) in a 90:10 weight ratio solvent of methanol and n-propanol and 10 grams of N,N'-diphenyl-N,N'-bis(3-hydroxyphenol)-[1,1'-biphenyl]-4,4"-diamine (a dihydroxy arylamine) in a roll mill for 2 hours. This coating solution is applied to the primed photoreceptor using a # 20 Meyer rod. This overcoat layer is air dried in a hood for 30 minutes. The air dried film is then dried in a forced air oven at 125° C. for 30 minutes. The overcoat layer thickness is approximately 3 micrometers.

EXAMPLE IX

The device is tested for charge carrier mobility by employing the time of flight technique. The time of flight experiments are carried out on a sandwich structure consisting of the electrically conductive titanium coated substrate, the barrier layer, the adhesive layer, the charge generator layer and the charge transport layer and the overcoat (the devices under study) and a vacuum deposited semi-transparent gold electrode. This sandwich is connected in a circuit containing a voltage power supply and a current measuring series resistance. The principal underlying this time of flight test is that when the gold electrode is biased negatively and the device exposed to a flash of light, holes photogenerated in the generator layer are injected into and drift through the transport layer. The electric current due to the carrier transit is time resolved and displayed on an oscilloscope. A constant current followed by a sharp drop-off was observed. The point at which the sharp drop occurs is the transit time. The transit time t tr is equal to the thickness of the transport layer divided by velocity, i.e. t tr=(TL thickness)/velocity. The relationship between the velocity and charge carrier mobility is velocity=(mobility)×(electric field). The formulations of the transport layers of the device and the results of the time of flight experiments carried out on the device is tabulated in the Table C below in Example XI.

EXAMPLE X

Two devices are fabricated similar to that in Example VII, except for the transport layer. The transport layer of this device consists of the same aromatic diamine of Example VII dispersed in polystyrene having a molecular weight of 80,000. The transport layer is fabricated by dissolving 1.73 grams of polystyrene and 0.5 gram of the aromatic diamine N,N'-diphenyl-N,N'-bis(3-methylphenyl)-(1,1'-biphenyl)-4,4'-diamine in 22.8 grams of methylene chloride. At the weight concentrations of this system, the molecular concentration (the number of diamine molecules per cm$^3$) is the same as that in Example VII. After dissolution, the mixture is coated on the substrate containing the charge generator layer using a 3 mil Bird film applicator. The films are dried in a forced air oven at 100° C. for 20 minutes.

EXAMPLE XI

One of the two devices of Example X is overcoated with dihydroxy arylamine in Elvamide 8063. Prior to application of the overcoat layer, the photoreceptor of Example VII is primed by applying 0.1 percent by weight of Elvacite 2008 in 90:10 weight ratio of isopropyl alcohol and water using a # 3 Meyer rod. This prime coating is air dried in a hood. The overcoat composition is prepared by mixing 10 grams of a 10 percent by weight solution of a polyamide (Elvamide 8063) in a 90:10 weight ratio solvent of methanol and n-propanol and 10 grams of N,N'-diphenyl-N,N'-bis(3-hydroxyphenol)-[1,1'-biphenyl]-4,4"-diamine (a dihydroxy arylamine) in a roll mill for 2 hours. This coating solution is applied to the primed photoreceptor using a # 20 Meyer rod. This overcoat layer is air dried in a hood for 30 minutes. The air dried film is then dried in a forced air oven at 125° C. for 30 minutes. The overcoat layer thickness is approximately 3 micrometers. The device is tested for charge carrier mobility by employing the time of flight technique described in Example IX. The formulations of the transport layers of this device and the device of Example VIII along with the results of the time of flight experiments carried out on the device are tabulated in Table C below.

TABLE C

| Device | Transport Layer Composition (wt. of Diamine 1 in one cubic cm of resin) | RESIN | Hole Mobility in $Cm^2$/Volt Second At $10^5$ Volts/cm |
|---|---|---|---|
| Example VIII | 0.3 gm | Poly-carbonate | $3.2 \times 10^{-8}$ |
| Example XI | 0.3 gm | Poly-styrene | $6.7 \times 10^{-7}$ |

The results show more than twentyfold increase in charge carrier velocities by replacing polycarbonate with polystyrene. The use of polystyrene binder in the transport layer and an overcoat of dihydroxy arylamine in Elamide, therefore, allows a dramatic increase in the process speed of the xerographic process as demonstrated in the next example, Example XII

EXAMPLE XII

Devices identical to those described in Examples VIII and XI, but without the gold electrode, are mounted in a scanner and tested to determine the relative process speeds to develop contrast potentials. The device is mounted on a cylindrical aluminum drum which is rotated on a shaft. The film is charged by a corotron mounted along the circumference of the drum. The surface potential is measured as a function of time by several capacitively coupled probes placed at different locations around the shaft. The probes are calibrated by applying known potentials to the drum substrate. The film on the drum is exposed and erased by light sources located at appropriate positions around the drum. The measurement consists of charging the photoconductor device in a constant current or voltage mode. As the drum rotates, the initial charging potential is measured by probe 1. Further rotation leads to the exposure station, where the photoconductor device is exposed to monochromatic radiation of known intensity. The surface potential after exposure is measured by probes 2 and 3. The device is finally exposed to an erase lamp of appropriate intensity and any residual potential is measured by probe 4. The process is repeated with the magnitude of the exposure automatically changed during the next cycle. A photo induced discharge characteristics (PIDC) is obtained by plotting the potentials at probes 2 and 3 as a function of exposure. The two devices are charged to a negative polarity by corotron charging and discharged by monochromatic light in the visible and in the IR portion of the light spectrum. The initial potential and the potential at 50 milliseconds after exposure to a flash of light were measured and tabulated in Table D.

TABLE D

| Device | Transport Layer Composition (wt of Diamine 1 in one cubic cm of resin) | RESIN | Initial Potential | Potential 50 milli sec after Exposure |
|---|---|---|---|---|
| Example VIII | 0.3 gm | Poly-carbonate | 1000 V | 960 V |
| Example XI | 0.3 gm | Poly-styrene | 1000 V | 230 V |

The results show that devices with transport layers containing molecular dispersions of charge transporting aromatic diamine in polystyrene with an overcoat of polyamide and dihydroxy arylamine can be employed in machines operating at significantly higher speeds.

EXAMPLE XIII

A device is fabricated similar to the device in Example VIII, except for the transport layer. The transport layer of this device consists of the same aromatic diamine of Example VIII dispersed in Makrolon Registered TM at a higher molecular concentration than in Example VIII. The transport layer is fabricated by dissolving 1.25 grams of Makrolon Registered TM and 1.25 grams of the aromatic diamine N,N'-diphenyl-N,N'-bis(3-methylphenyl)-(1,1'-biphenyl)-4,4'-diamine in 22.8 grams of methylene chloride. After dissolution, the mixture is coated on the substrate containing the charge generator layer using a 3 mil Bird film applicator. The film is dried in a forced air oven at 100° C. for 20 minutes. The device is overcoated with dihydroxy arylamine in Elvamide 8063. Prior to application of the overcoat layer, the photoreceptor device is primed by applying 0.1 percent by weight of Elvacite 2008 in 90:10 weight ratio of isopropyl alcohol and water using a # 3 Meyer rod. This prime coating is air dried in a hood. The overcoat composition is prepared by mixing 10 grams of a 10 percent by weight solution of a polyamide (Elvamide 8063) in a 90:10 weight ratio solvent of methanol and n-propanol and 10 grams of N,N'-diphenyl-N,N'-bis(3-hydroxyphenol)-[1,1'-biphenyl]-4,4"-diamine (a dihydroxy arylamine) in a roll mill for 2 hours. This coating solution is applied to the primed photoreceptor using a # 20 Meyer rod. This overcoat layer is air dried in a hood for 30 minutes. The air dried film is then dried in a forced air oven at 125° C., for 30 minutes. The overcoat layer thickness is approximately 3 micrometers. The device is tested for charge carrier mobility by employing the time of flight technique described in Example IX. The formulations of the transport layers of the device and the results of the time of flight experiments carried out on the device are tabulated in the Table E below in Example XV.

EXAMPLE XIV

Two devices are fabricated similar to the device in Example XI, except for the transport layer. The transport layer of this device consists of the same aromatic diamine of Example XI dispersed in polystyrene. The transport layer is fabricated by dissolving 1.08 grams of polystyrene and 1.25 grams of the aromatic diamine N,N'-diphenyl-N,N'-bis(3-methylphenyl)-(1,1'-biphenyl)-4,4'-diamine in 22.8 grams of methylene chloride. At the weight concentrations of this system, the molecular concentration (the number of diamine molecules per $cm^3$) is the same as that in Example XIII.

EXAMPLE XV

One of the two devices of Example XIV is overcoated with dihydroxy arylamine in Elvamide 8063. Prior to the application of the overcoat layer, the photoreceptor is primed by applying 0.1 percent by weight of Elvacite 2008 in 90:10 weight ratio of isopropyl alcohol and water using a # 3 Meyer rod. This prime coating is air dried in a hood. The overcoat composition is prepared by mixing 10 grams of a 10 percent by weight solution of a polyamide (Elvamide 8063) in a 90:10 weight ratio solvent of methanol and n-propanol and 10 grams of N,N'-diphenyl-N,N'-bis(3-hydroxyphenol)-[1,1'-biphenyl]-4,4"-diamine (a dihydroxy arylamine) in a roll mill for 2 hours. This coating solution is applied to the primed photoreceptor using a # 20 Meyer rod. This overcoat layer is air dried in a hood for 30 minutes. The air dried film is then dried in a forced air oven at 125° C. for 30 minutes. The overcoat layer thickness is approximately 3 micrometers. After dissolution, the mixture is coated on the substrate containing the charge generator layer using a 3 mil Bird film applicator. The film is dried in a forced air oven at 100° C. for 20 minutes. The device is tested for charge carrier mobility by employing the time of flight technique described in Example IX. The formulations of the transport layers of the device and the results of the time of flight experiments carried out on the device is tabulated in the Table E below:

TABLE E

| Device | Transport Layer Composition (wt. of Diamine 1 in one cubic cm of resin) | RESIN | Hole Mobility in $Cm^2$/Volt Second At $10^5$ Volts/cm |
|---|---|---|---|
| Example XIII | 0.3 gm | Poly-carbonate | $1.8 \times 10^{-8}$ |
| Example XV | 1.2 gm | Poly-styrene | $5.4 \times 10^{-5}$ |

The mobility value is considerably higher when polystyrene is substituted for Makrolon®. The results show that devices with transport layers containing molecular dispersions of charge transporting aromatic diamine in polystyrene and overcoats of dihydroxy arylamine in polyamide can be employed in machines operating at significantly higher speeds.

EXAMPLE XVI

A turntable device is fitted with a polyurethane blade configured in the doctor mode. The blade is adjustable for reproducible setting of the nip gap. A metered dispenser is used to feed specific quantities of a single component developer from the Xerox 5012 electrophotographic imaging machine. This developer acts as the abrading agent. This device is employed to to test wear of materials by abrasion. Wear is calculated in nanometers per kilocycles rotation (nm/Kcs). Reproducibility of calibration standards is about ±2 nm/Kc. Sample wear is measured by an interference measuring device, known as the Otsuka gauge. The device of Example XIV (of the prior art with a transport layer containing a dispersion of diamine in polystyrene: U.S. Pat. No. 5,028,502) is compared to the overcoated device of Example XIV. The wear rate of the device from Example XIV is 60 nm/Kc and the wear rate of the device in Example XV is 8 nm/Kc, more than seven times improvement.

Although the invention has been described with reference to specific preferred embodiments it is not intended to be limited thereto, rather those skilled in the art will recognize that variations and modifications may be made therein which are within the spirit of the invention and within the scope of the claims

What is claimed is:

1. An electrophotographic imaging member comprising a supporting substrate, a charge generating layer, a charge transport layer and an overcoating layer, said transport layer comprising a charge transporting molecule in a polystyrene matrix and said overcoating layer comprising a hole transporting hydroxy arylamine compound having at least two hydroxy functional groups and a polyamide film forming binder capable of forming hydrogen bonds with said hydroxy functional groups of said hydroxy arylamine compound.

2. An electrophotographic imaging process according to claim 1 wherein said polystyrene has a weight average molecular weight between about 20,000 and about 5,000,000.

3. An electrophotographic imaging member according to claim 1 wherein the said transport layer has a thickness of between about 5 micrometers and about 50 micrometers.

4. An electrophotographic imaging member according to claim 1 wherein said charge transporting molecule in said charge transport layer molecule is an aromatic diamine represented by the formula:

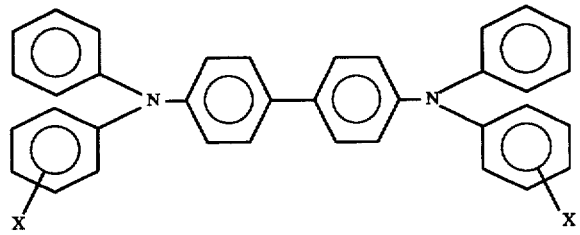

wherein X is selected from the group consisting of an alkyl group containing from 1 to 4 carbon atoms and chlorine.

5. An electrophotographic imaging member according to claim 4 wherein said charge transport layer comprises between about 15 percent and about 75 percent by weight of said aromatic diamine based on the total weight of said charge transport layer.

6. An electrophotographic imaging member according to claim 1 wherein said film forming polyamide is represented by the following formulae I and II:

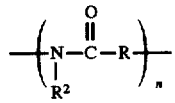

I wherein:

n is a positive integer,

R is independently selected from the group consisting of alkylene, arylene or alkarylene units, between 1 and 99 percent of the $R^2$ sites are —H, and the remainder of the $R^2$ sites are —$CH_2$—O—$CH_3$ and

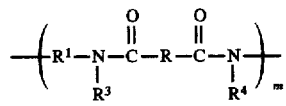

II wherein:

m is a positive integer, $R_1$ and R are independently selected from the group consisting of alkylene, arylene or alkarylene units, between 1 and 99 percent of the $R^3$ and $R^4$ sites are —H, and the remainder of the $R^3$ and $R^4$ sites are $—CH_2—O—CH_3$.

7. An electrophotographic imaging member according to claim 1 wherein said hydroxy arylamine compound is represented by the formula:

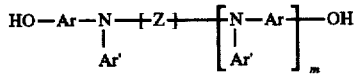

wherein:

m is 0 or 1,

Z is selected from the group consisting of:

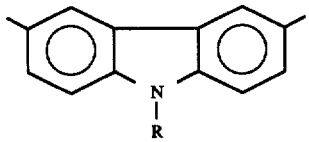

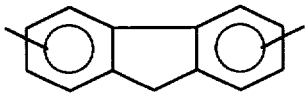

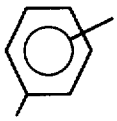

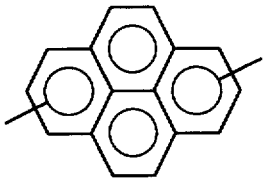

and

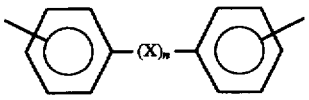

n is 0 or 1,

Ar is selected from the group consisting of:

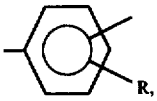

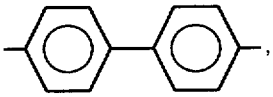

and

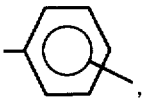

R is selected from the group consisting of $—CH_3$, $—C_2H_5$, $—C_3H_7$, and $—C_4H_9$, Ar' is selected from the group consisting of:

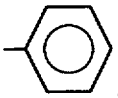

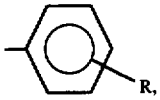

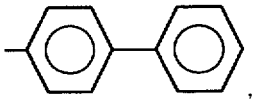

and

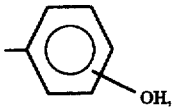

X is selected from the group consisting of:

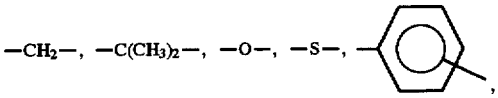

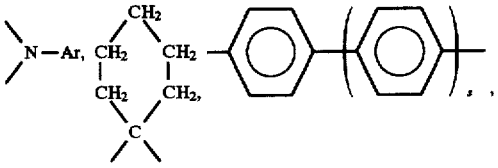

and 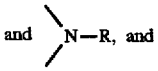 and s is 0, 1 or 2, said hydroxy arylamine compound being free of any direct conjugation between the —OH groups and the nearest nitrogen atom through one or more aromatic rings.

8. An electrophotographic imaging member according to claim 1 wherein said film forming polyamide contains —CONH groups capable of forming hydrogen bonds with hydroxy functional groups of said hydroxy arylamine compound.

9. An electrophotographic imaging member according to claim 1 wherein said overcoating layer comprises between about 20 percent and about 50 percent by weight of said hydroxy arylamine compound based on the total weight of said overcoating layer after drying.

10. An electrophotographic imaging device according to claim 1 wherein the said overcoat layer is a continuous layer having a thickness of up to about 10 micrometers.

11. An imaging process comprising providing an electrophotographic imaging member comprising a supporting substrate, a charge generating layer, a charge transport layer and an overcoating layer, said transport layer comprising a charge transporting molecule in a polystyrene matrix and said overcoating layer comprising a hole transporting hydroxy arylamine compound having at least two hydroxy functional groups and a polyamide film forming binder capable of forming hydrogen bonds with said hydroxy functional groups of said hydroxy arylamine compound, depositing a uniform electrostatic charge on said imaging member with a corona charging device, exposing said imaging member to activating radiation in image configuration to form an electrostatic latent image on said imaging member, developing said electrostatic latent image with electrostatically attractable toner particles to form a toner image, transferring said toner image to a receiving member and repeating said depositing, exposing, developing and transferring steps, the time elapsed between said exposing and the developing steps is between about 0.5 millisecond and about 500 milliseconds.

12. An electrophotographic imaging process according to claim according to claim 13 wherein the time elapsed between said exposing and the developing steps is between about 1 millisecond and about 200 milliseconds.

* * * * *